United States Patent [19]

Schuierer

[11] 3,930,465

[45] Jan. 6, 1976

[54] APPARATUS FOR APPLYING A FILM OF LIQUID TO A WEB OF MATERIAL

[75] Inventor: Manfred Schuierer, Michelstadt, Germany

[73] Assignee: Bruckner Apparatebau GmbH, Postfach, Germany

[22] Filed: Jan. 16, 1975

[21] Appl. No.: 541,498

[30] Foreign Application Priority Data

Jan. 30, 1974 Germany ..... 7403152[U]

[52] U.S. Cl. ..... 118/325; 118/DIG. 4; 118/429

[51] Int. Cl.[2] ..... B05C 5/00

[58] Field of Search ..... 118/200, 324, 325, 400, 118/407, 429, DIG. 4; 427/420, 434

[56] References Cited

UNITED STATES PATENTS

| | | | |
|---|---|---|---|
| 2,060,897 | 11/1936 | Richardson et al. | 118/DIG. 4 |
| 2,673,763 | 3/1954 | Dunn | 118/DIG. 4 |
| 2,933,061 | 4/1960 | Galer | 118/407 |
| 3,345,972 | 9/1967 | Masulis | 118/324 |
| 3,605,689 | 9/1971 | Sherwood | 118/407 |
| 3,694,142 | 9/1972 | Schuierer | 118/407 |
| 3,717,121 | 2/1973 | Bruckbauer et al. | 118/DIG. 4 |

*Primary Examiner*—Mervin Stein
*Assistant Examiner*— Douglas Salser
*Attorney, Agent, or Firm*—Marshall & Yeasting

[57] ABSTRACT

An apparatus for applying a thin liquid film to a continuously moving web of large width comprises a liquid supply chamber adapted to be fed by a pump. A smoothly tensioned foil, arranged to receive liquid from the supply chamber, constitutes a guide surface to form a liquid film, and has a lower edge arranged to discharge the film onto the web of material. Means arranged ahead of the foil is provided for calming the liquid.

9 Claims, 4 Drawing Figures

APPARATUS FOR APPLYING A FILM OF LIQUID TO A WEB OF MATERIAL

BACKGROUND OF THE INVENTION

The invention relates to an apparatus for applying a thin liquid film of large width to a continuously moving web of material, comprising a liquid supply chamber which is fed by a pump and a guide surface which is supplied from the liquid supply chamber and from the edge of which a liquid film runs onto the web of material.

For applying a thin liquid film to a continuously moving web of material, it is known to convey a liquid film by means of a roll from a liquor trough and to remove said film from the roll by means of a doctor, the film then passing from said doctor to the web of material. However, this generally requires a thickening agent to obtain satisfactory film formation on the roll. This then requires subsequent washing of the web of material to remove the thickening agent.

It is further known to immerse a roll in a liquid supply container which is fed from a pump with the liquor and comprises an overflow weir, said roll being disposed adjacent the overflow weir and serving primarily to break the waves caused by the liquor supply. In this construction a relatively large volume is required for the liquid supply container so that the conveying impulses originating from the pump have the least possible effect at the guide surface following the overflow weir. A large volume of the liquid supply container involves however considerable practical disadvantages, as should be readily obvious (for example, the losses when changing the colour).

SUMMARY OF THE INVENTION

The invention is thus directed to the problem of constructing an apparatus of the class described in such a way as to eliminate the defects of the prior devices, so that without a particularly large liquid supply chamber, the application of a thin liquid film that is completely uniform over the entire width of the material web is ensured.

According to the invention this problem is solved by providing a guide surface in the form of a smoothly tensioned foil, and also providing means for calming the liquid in front of the foil.

As extensive tests have shown, such a smoothly tensioned foil set at an exactly uniform slope (for example a metal foil having a thickness of 0.1 mm) guarantees the supply of a completely uniform thin liquid film to the web of material if it is ensured that pump impulses or surges do not have any effect on the liquid disposed on the foil. For this purpose, according to the invention means for calming the liquid are provided in front of the foil.

DESCRIPTION OF THE PREFERRED EMBODIMENTS

Figure 1:
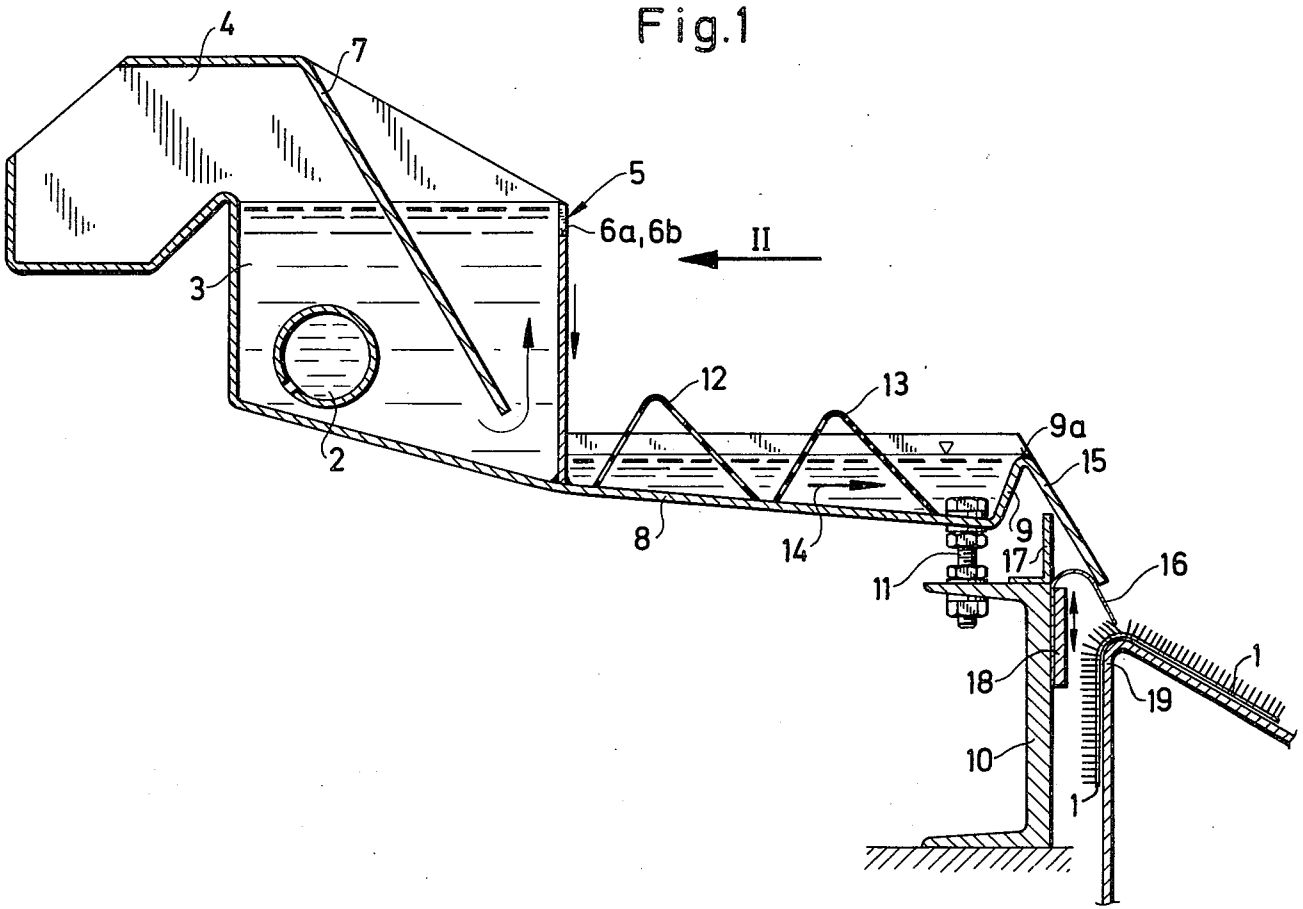
FIG. 1 is a schematic vertical section of a first embodiment of the invention.
Figure 2:
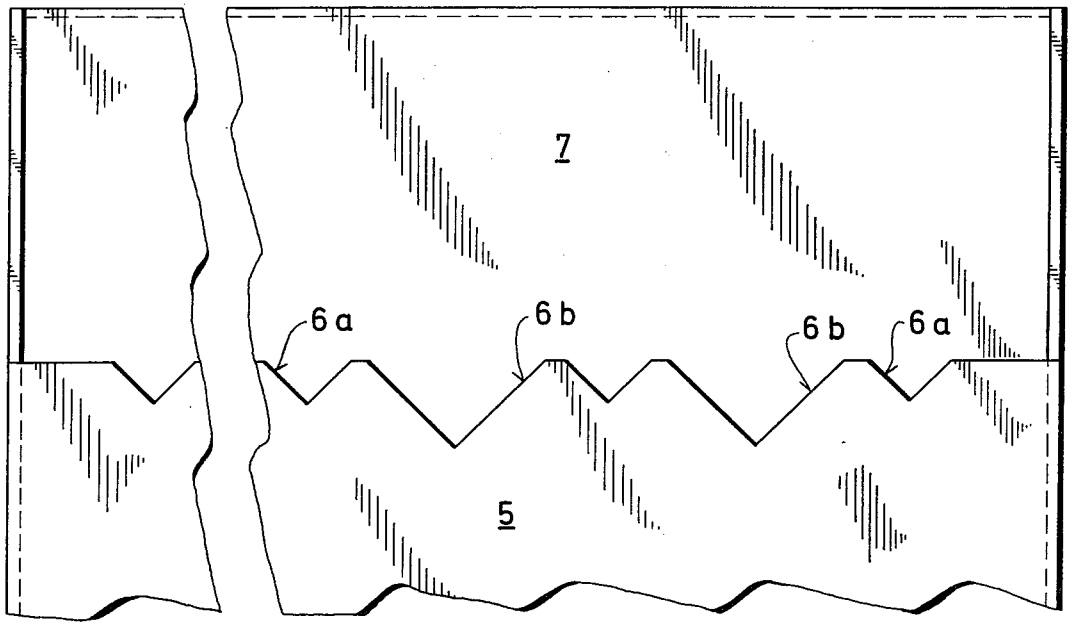
FIG. 2 is a fragmentary end view of the overflow weir of the apparatus according to FIG. 1.

The apparatus illustrated in FIGS. 1 and 2 for applying a thin liquid film (for example a dye liquor) to a continuously moving material web 1 of large width (for example a polyamide fibre carpet) comprises a liquid entrance chamber 3 fed by a pump via a conduit 2 and comprising a discharge opening 4 for foam exit and an overflow weir 5. Said overflow weir 5 comprises, as particularly apparent from FIG. 2, a plurality of triangular cut-outs 6*a*, 6*b* at its overflow edge which are uniformly distributed over the entire width of the overflow weir 5. In addition, the overflow weir 5 may be provided with circular openings (not illustrated) which are arranged at the same or different levels. Also disposed in the liquid entrance chamber 3 is an inclined wall 7 which shields the region surrounding the conduit 2 from the overflow weir 5 and thus contributes to effecting that the conveying impulses originating from the pump reach the overflow weir 5 only to a weakened degree.

The apparatus also comprises a flat container 8 which is only slightly inclined (having for example an angle of inclination between 2° and 10° but in no case more than 40°). Said flat container 8 is closed at its discharge end by a small damming wall 9 and bears in the vicinity of said wall 9 on a very solid support beam 10. The upper edge 9*a* of the damming wall 9 is adjustable into an exactly horizontal position by screws 11.

In the embodiment illustrated in FIGS. 1 and 2 the shallow container comprises two triangularly bent perforated barriers 12, 13, the diameters of the perforations in said barriers 12, 13 decreasing in the direction of flow of the liquid (arrow 14). These barriers 12, 13 provide a further calming of the liquid.

Following the small damming wall 9 on the discharge side is an inclined metal sheet 15, followed by a resilient foil 16 which is clamped on the one hand by means of two clamping members 17, 18 to the support beam 10 and on the other hand bears with adjustable tension on the lower run-off edge of the inclined sheet 15. In this manner the foil 16 is tensioned so that it is completely smooth over the entire width of the apparatus (for example 5 m) and extends with an exactly uniform slope. Thus a thin liquid film passes from the foil 16 to the web of material 1, which in the region beneath the run-off edge of the foil 16 is led over a highly curved support 19 so that for example in the case of a web of carpet material the nap is widely opened.

Figure 3:
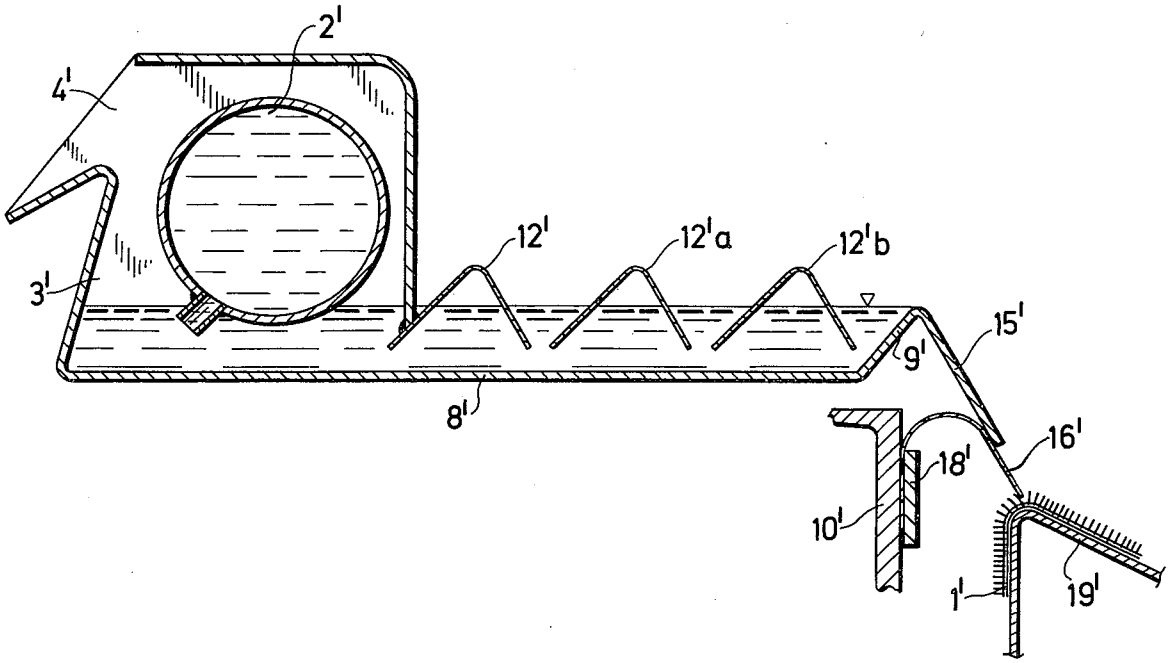
FIGS. 3 and 4 are schematic vertical sections of two further embodiments.

In the further embodiment of the invention illustrated in FIG. 3 corresponding parts are denoted by the same reference numerals as in FIGS. 1 and 2 (with an apostrophe added). In this case no overflow weir is provided between the liquid entrance chamber 3' and the shallow container 8'. The barriers 12', 12'*a* and 12'*b* are arranged at a distance above the bottom of the shallow container 8' so that the liquid can pass beneath said barriers (which in this case are not perforated). In this case as well the foam can flow out from the entrance chamber 3' through the opening 4'.

Figure 4:
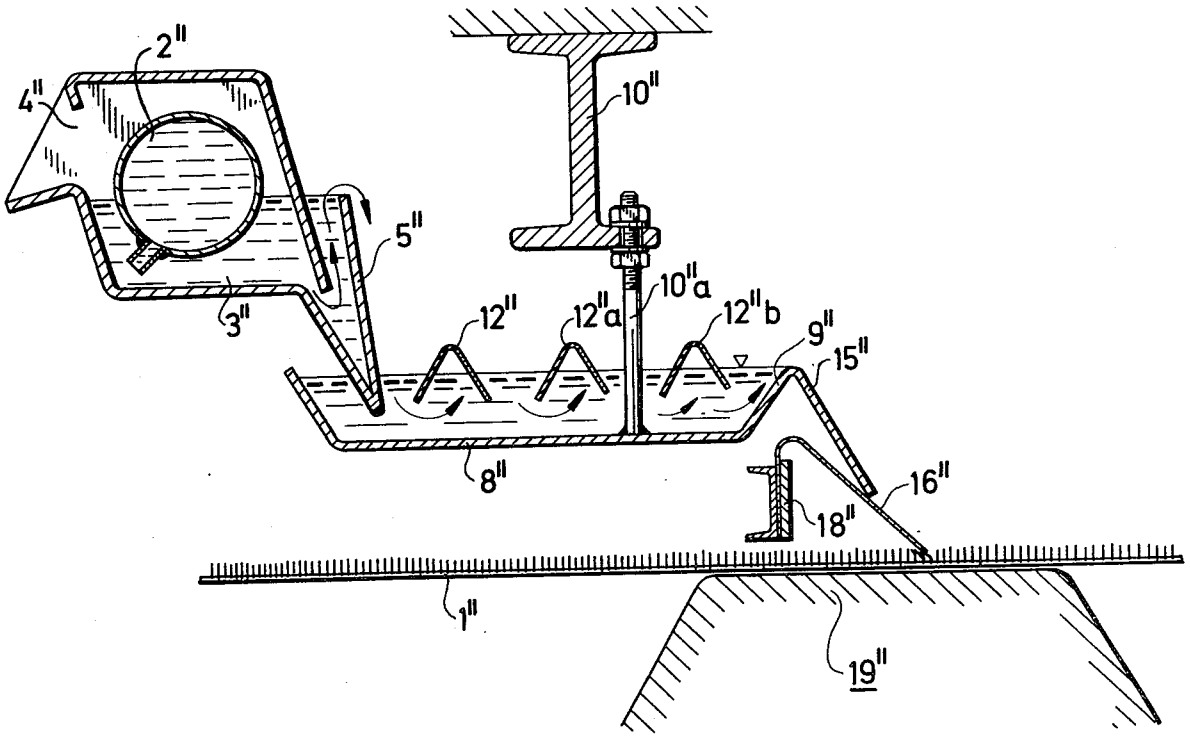

In the embodiment according to FIG. 4 parts corresponding to those in the previous figures of the drawings are given the same reference numerals but with a double apostrophe. The unperforated barriers 12'', 12''*a* and 12''*b* are arranged in the manner shown in FIG. 3, spaced above the bottom of the shallow container 8''. The liquid leaves the entrance chamber 3'' via the overflow weir 5'' and enters the container 8''.

In contrast to the embodiment of FIG. 1, according to FIG. 4 the shallow container 8'' is suspended on the support beam 10'', which from the constructional point of view has the advantage that the space beneath the shallow container 8'' remains free for guiding the material web 1'' or for accommodating other parts. With this arrangement it has been found advantageous for the members 10''*a* serving to suspend the container 8'' on the support beam 10'' to be disposed between two barriers so that the liquid after passing said members 10''*a* must still pass at least one further barrier (12''*b*) before it reaches the damming wall 9'' and flows as a uniform liquid film over the foil 16'' onto the material web 1''.

I claim:

1. Apparatus for applying a thin liquid film to a continuously moving web of large width, comprising a liquid supply chamber in the form of a slightly inclined shallow container which is adapted to be fed with a liquid at its higher end and is defined at its lower end by a damming wall over which the liquid is discharged, a plurality of barrier means for calming the liquid, disposed in the shallow container in the path of liquid flowing from the higher end to the lower end, and a flexible foil of thin, resilient metal which is adjustably clamped along one edge and has its opposite edge arranged to receive liquid flowing over said damming wall and to discharge a film of the liquid onto the moving web.

2. Apparatus according to claim 1, wherein a plurality of perforated barriers in series are provided extending across the container, and the size of the perforations in the barriers decreases in the direction of flow of the liquid.

3. Apparatus according to claim 1 comprising at least one barrier which dips into the liquid and is spaced from the bottom of the container.

4. Apparatus according to claim 1, wherein the shallow container is preceded by a liquid entrance chamber which is defined on the side toward such container by an overflow weir having a plurality of triangular cutouts over the width of its overflow edge.

5. Apparatus according to claim 1, wherein the shallow container is mounted on a solid support beam by means of screws for leveling the container.

6. Apparatus according to claim 5, wherein the shallow container is suspended from the support beam.

7. Apparatus according to claim 6, wherein at least one member for suspending the shallow container from the support beam is secured to the bottom of the container, and at least one barrier for calming the liquid extends across the container between such member and the damming wall which defines the container at its lower end.

8. Apparatus according to claim 4, wherein the entrance chamber has a liquid inlet and contains a partition that shields the overflow weir from the region surrounding such inlet.

9. Apparatus according to claim 4, wherein the entrance chamber is provided with an opening for removing liquid foam.

* * * * *